US010369783B2

(12) United States Patent
Kumazawa et al.

(10) Patent No.: US 10,369,783 B2
(45) Date of Patent: Aug. 6, 2019

(54) INK JET PRINTING METHOD PRINTING A TEST SUBSTRATE AND A PRINTING TARGET

(71) Applicant: Panasonic Intellectual Property Management Co., Ltd., Osaka (JP)

(72) Inventors: Kentaro Kumazawa, Osaka (JP); Shuhei Nakatani, Osaka (JP); Takao Nagumo, Osaka (JP); Takashi Inoue, Osaka (JP); Futoshi Ohtsuka, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/886,811

(22) Filed: Feb. 1, 2018

(65) Prior Publication Data

US 2018/0222180 A1 Aug. 9, 2018

(30) Foreign Application Priority Data

Feb. 8, 2017 (JP) ..... 2017-021474
Dec. 11, 2017 (JP) ..... 2017-236572

(51) Int. Cl.
*B41J 2/21* (2006.01)
*B41J 11/00* (2006.01)
(Continued)

(52) U.S. Cl.
CPC ..... *B41J 2/04526* (2013.01); *B41J 2/04503* (2013.01); *B41J 2/04556* (2013.01);
(Continued)

(58) Field of Classification Search
CPC .. B41J 2/04526; B41J 2/2135; B41J 11/0035; B41J 11/0095; B41J 19/145;
(Continued)

(56) References Cited

U.S. PATENT DOCUMENTS 5,988,784 A * 11/1999 Takemura ..... B41J 2/04503 347/14
2006/0214976 A1* 9/2006 Iwao ..... B41J 29/393 347/19

FOREIGN PATENT DOCUMENTS

JP 6-143724 5/1994
JP 2001-121693 5/2001

* cited by examiner

*Primary Examiner* — Bradley W Thies
(74) *Attorney, Agent, or Firm* — Greenblum & Bernstein, P.L.C.

(57) ABSTRACT

A high precision printing method taking into consideration the variance in the thickness of a printing target. An ink-jet printing method, including: (i) measuring a distance between a printing target and at least one nozzle; (ii) measuring a flying speed and a flying angle of an ink(a) discharged from the at least one nozzle; (iii) printing a test substrate with an ink to identify a location on which an ink(b) is spotted, and calculating a thickness-related displacement that is a displacement from the location on which the ink is spotted, based on a thickness difference between the printing target and the test substrate from results obtained in Step (i), and the flying speed and the flying angle of the ink(a) obtained in Step (ii); and (iv) discharging an ink(c) from the at least one nozzle to achieve actual printing of the printing target with the ink(c) while correcting the thickness-related displacement.

14 Claims, 9 Drawing Sheets

(51) Int. Cl.

| | |
|---|---|
| ***B41J 19/14*** | (2006.01) |
| ***B41J 2/045*** | (2006.01) |
| ***B41J 2/135*** | (2006.01) |
| ***B41J 29/393*** | (2006.01) |

(52) U.S. Cl.
CPC ..... *B41J 2/04586* (2013.01); *B41J 2/135* (2013.01); *B41J 2/2135* (2013.01); *B41J 11/0035* (2013.01); *B41J 11/0095* (2013.01); *B41J 19/145* (2013.01); *B41J 29/393* (2013.01); *B41J 2202/01* (2013.01)

(58) Field of Classification Search
CPC ..... B41J 2/04556; B41J 2/04503; B41J 2/04586; B41J 2/135; B41J 29/393; B41J 2202/01
See application file for complete search history.

FIG. 9

| GAP 1.0mm | | INK-JET HEAD | |
|---|---|---|---|
| | | CENTER | EDGE |
| PRINTING TARGET | FRONT SIDE | 5μm | 8μm |
| | CENTER | 1μm | 6μm |
| | DEPTH SIDE | 1μm | 6μm |
| GAP 1.5mm | | INK-JET HEAD | |
| | | CENTER | EDGE |
| PRINTING TARGET | FRONT SIDE | 7μm | 12μm |
| | CENTER | 3μm | 8μm |
| | DEPTH SIDE | 3μm | 8μm |
| GAP 2.0mm | | INK-JET HEAD | |
| | | CENTER | EDGE |
| PRINTING TARGET | FRONT SIDE | 13μm | 20μm |
| | CENTER | 5μm | 16μm |
| | DEPTH SIDE | 5μm | 16μm |

INK JET PRINTING METHOD PRINTING A TEST SUBSTRATE AND A PRINTING TARGET

TECHNICAL FIELD

The technical field relates to ink-jet printing methods.

BACKGROUND

Drop-on-demand ink-jet heads (referred to as head(s)) allow requisite amounts of inks to be applied when needed, in response to input signals.

Ink-jet technologies are expected to serve as technologies for producing organic EL displays and liquid crystal panels (for example, JP-A-2001-121693).

In ink-jet devices, displacement of spotting positions during the printing process will greatly affect printing quality.

Such displacement of ink-spotting positions can be caused from displacement of printing targets or nozzles, variations in ink-flying speeds and ink-discharging angles in nozzles, displacement of heads in reciprocating printing techniques, and variations in distances between printing targets and heads.

One example of a conventional technique for solving such a problem, is preliminarily storing offsets with respect to ink-flying speeds, carriage-shifting speeds, and distances between heads and printing targets. Then, driving signals are generated by correcting driving-signal table data based on the offsets, and supplied to the heads. Thus, spotting position displacement is prevented (see for example, JP-A-H6-143724).

SUMMARY

However, the conventional arts have not addressed the occurrence of reductions in ink-flying speeds in cases where printing targets vary in thicknesses.

In cases of print images that are seen by human eyes, a degree of precision of ink-spotting positions is about ±15 μm at 3σ, and thus, the variations in the thickness would be a problem.

However, in cases in which printing techniques are employed for the production of displays, displays have higher resolution year by year. Therefore, ink-spotting precision on the scale of several micrometers is required in such cases. For example, it is required that droplets are spotted onto 30 μm cells in 300 ppi displays.

An object of the disclosure is to provide ink-jet printing methods that make it possible to realize high-precision printing even in cases where there are variations in the thicknesses of the printing targets.

According to an aspect of the disclosure, provided is an ink-jet printing method, including: (i) measuring a distance between a printing target and at least one nozzle; (ii) measuring a flying speed and a flying angle of an ink (a) discharged from the at least one nozzle; (iii) printing a test substrate with an ink(b) to identify a location on which the ink is spotted, and calculating a thickness-related displacement that is a displacement from the location on which the ink is spotted, based on a thickness difference between the printing target and the test substrate from results obtained in Step (i), and the flying speed and the flying angle of the ink(a) obtained in Step (ii); and (iv) discharging the ink from the at least one nozzle to achieve actual printing of the printing target with an ink(c) while correcting the thickness-related displacement.

According to the disclosure, it becomes possible to realize high-precision printing even in case where printing targets having variations in their thicknesses are subjected to the printing processes.

BRIEF DESCRIPTION OF THE DRAWINGS

FIG. 9 shows a correction table for correcting the influence of uneven airflows on ink spotting over edges and a central area of a printing target in the fourth embodiment.

DESCRIPTION OF EMBODIMENTS

Figure 1:
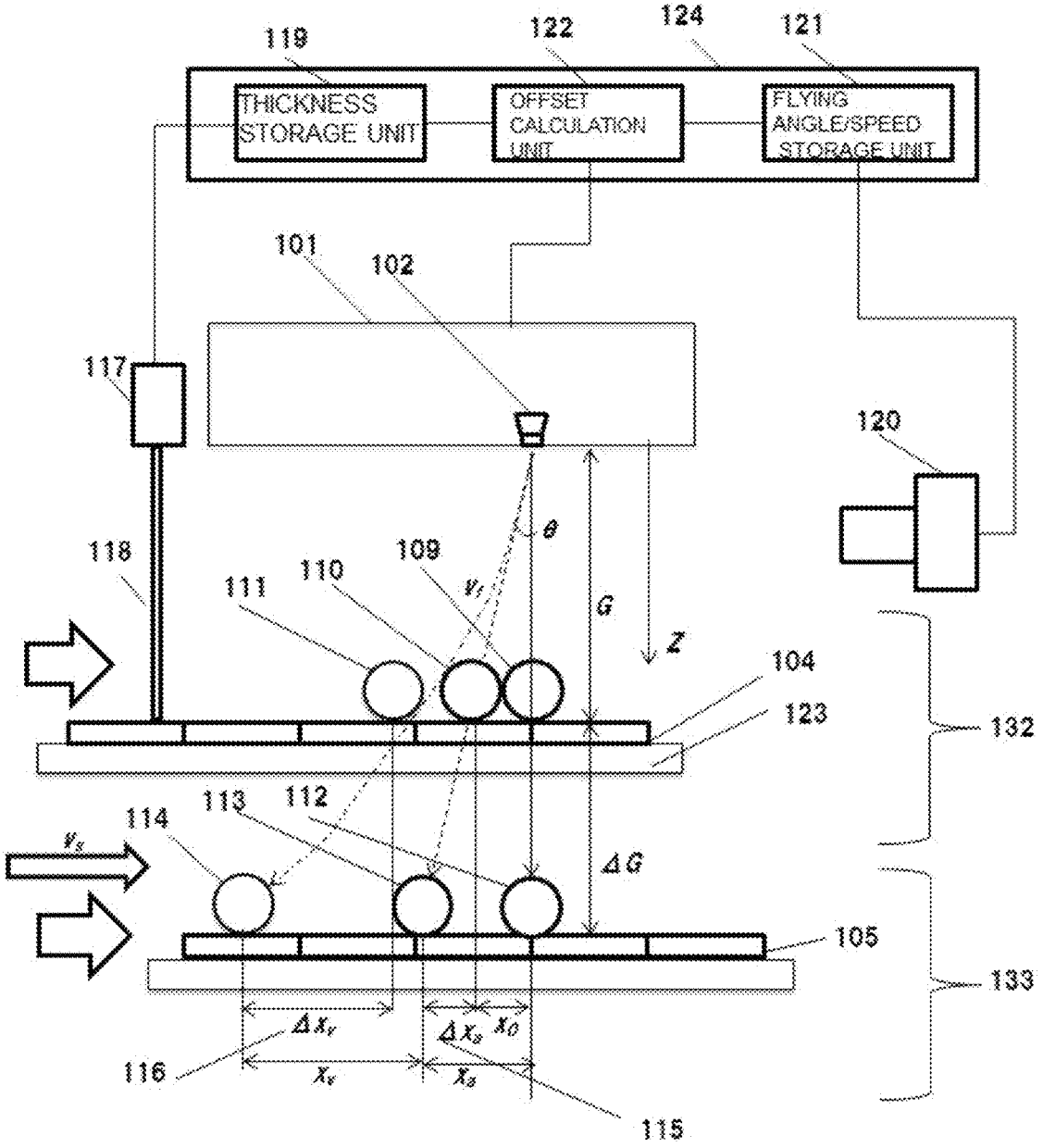
FIG. 1 is a side view of an ink-jet device according to a first embodiment in an ink-discharging state.

Hereinafter, embodiments of the disclosure will be described with reference to the drawings.

First Embodiment

In ink-jet printing processes, discharged inks are possibly spotted on locations deviating from the target ink-spotting locations.

Such displacement is corrected based on steps described below.

That is, the correction process is carried out based on a distance-measurement step, a flying speed/angle measurement step, a test-printing step, and an actual printing step, as mentioned below.

At first, the correction process will be described based on the side view of FIG. 1.

In addition, the steps described below may be realized by a certain control chip in an ink-jet device.

Alternatively, the steps may be realized by programs run by processors and memories provided in ink-jet devices.

Alternatively, the steps may be realized by programs run by remote computers that control the inkjet devices.

Accordingly, the "steps" can be replaced with "units" realizing the respective steps.

<Distance-Measurement Step>

In the distance-measurement step, the thickness of an actual printing target 105 that will be a product is measured by thickness-measurement unit 117, and a gap distance between a surface of the nozzle 102 and a surface of the actual printing target 105 is calculated.

In cases in which the thickness of a test substrate 104 is not known, the thickness of the test substrate 104 is also measured.

The actual printing target 105 is a substrate that is used in the actual printing step.

The test substrate 104 is a substrate that is used in the test printing step.

Additionally, substrates not used in the actual printing step are referred to as test substrates.

<Flying Speed/Angle Measurement Step>

In the flying speed/angle measurement step, a speed/angle measurement unit 120 measures flying angles and flying speeds of inks discharged from multiple nozzles 102.

<Test Printing Step>

In the test printing step 132, the test substrate 104 is subjected to test printing.

As shown in FIG. 1, the test substrate 104 is caused to pass under the ink-jet head 101 from the left hand side to the right hand side.

In this case, the ink-jet head 101 discharges inks when the test substrate 104 passes directly under the ink-jet head 101.

The inks discharged from the nozzles 102 in the ink-jet head 101 may be spotted onto the test substrate 104 at flying angles and flying speeds different from each other.

Additionally, the timing of ink discharges are calculated based on distances between the test substrate 104 and nozzles, flying angles and flying speeds of the inks, and the moving speed of the test substrate 104 relative to the nozzles. Thus, target spotting locations are printed with the inks.

The locations of the inks spotted over the test substrate 104 are calculated.

Initial displacements between the target ink-spotting locations and the actual ink-spotted locations over the test substrate 104 are calculated.

Then, based on the results obtained in the distance-measurement step, a difference between the thicknesses of the test substrate 104 and the actual printing target 105 is calculated.

Thickness-related displacements for the ink-spotted locations caused from the above-calculated thickness difference are calculated from the flying angles and the flying speeds obtained in the flying speed/angle measurement step.

Thickness-related displacements correspond to distances of displacement between the ink-spotted locations in the test printing step and ink-spotted locations in the actual printing step described below.

For example, the thickness-related displacements correspond to a sum of a speed-related displacement 116 and an angle-related displacement 115 in FIG. 1 mentioned below.

Additionally, in cases where there are no initial location displacements, no corrections are required.

For example, in cases where a distance between the test substrate 104 and the nozzles are small, there will be almost no initial location displacements. Therefore, in such cases, corrections concerning the initial displacements are not required.

<Actual Printing Step>

In the actual printing step 133, a printing process is carried out with respect to the actual printing target 105 that is an actual production substrate.

In the actual printing step 133, the ink-spotted locations in the test printing step 132 are corrected based on the initial displacements and the thickness-related displacements in the test printing step 132, so as to carry out printing of the actual printing target 105.

In addition, in cases where there are no initial displacements and the ink-spotted locations in the test printing step 132 correspond to target ink-spotting locations, corrections are carried out for the thickness-related displacements.

In FIG. 1, how the inks discharged from the nozzles in the test printing step 132 and the actual printing step 133 are spotted onto the printing targets (the test substrate 104 and the actual printing target 105) is shown.

In FIG. 1, since both the test printing step 132 and the actual printing step 133 are depicted in the longitudinal direction, the thickness of the test substrate 104 in the test printing step 132, and the thickness of the actual printing target 105 in the actual printing step 133 can be different from one another.

In this case, locations onto which inks are spotted without any curving of pathways of discharged inks at certain angles, and without any flying time while the nozzles 102 exist in a direction of a normal to the test substrate 104 are defined as ideal ink-spotting locations 109.

One nozzle 102 or multiple nozzles 102 may be provided in the disclosure.

In the case in which multiple nozzles 102 are provided, each of the steps is carried out with respect to each of the nozzles 102.

<Phenomena>

(i) In Cases Where Pathways of the Discharged Inks Are Curved at a Certain Angle.

In this case, there is a gap between the ink-spotted location 110 causing curving of the discharged ink in the test printing step 132 and the ideal ink-spotting location 109.

(ii) In Cases Where There is a Thickness Difference ΔG Between the Test Substrate 104 and the Actual Printing Target 105.

In such cases, an angle-related displacement 115 is caused between the ink-spotted location 110 in the test printing step 132 and the ink-spotted location 113 in the actual printing step 133.

The angle-related displacement 115 will vary with the flying angle of the ink and the thickness difference ΔG between the printing targets.

Therefore, in order to correct the angle-related displacement 115, it is required that the flying angle of the ink is stored somewhere, and thickness difference ΔG between the printing targets is taken into consideration.

(iii) In a Case Where the Flying Speed of the Ink is Reduced Besides Curving of the Discharged Ink.

In such a case, there will be a larger displacement concerning ink-spotted locations compared with the ink-spotted location 110 in the test printing step 132 in above case (ii), and the ink is spotted onto an ink-spotted location 111.

In the same manner, the ink is spotted onto an ink-spotted location 114 in the actual printing step 133.

The speed-related displacement 116 between the ink-spotted location 111 in the test printing step 132 and the ink-spotted location 114 in the actual printing step 133 will be increased by reductions in the flying speed of the ink.

This is because, if the flying speed of the ink is reduced, it takes longer for the ink to come into contact with the printing target, and thus, the printing target is accordingly moved from the left hand side to the right hand side in FIG. 1 until the ink comes into contact with it.

<Solutions>

As described above, the correction process is conducted by sequentially carrying out the distance-measurement step, the flying angle/speed measurement step, the test printing step 132, and the actual printing step 133.

Hereinafter, (i) the distance-measurement step, (ii) the flying speed/angle measurement step, and (iii) the test printing step 132 will be described in more detail.

(i) Distance-Measurement Step

In the distance-measurement step, the thickness-measurement unit 117 radiates a laser beam 118 against the test substrate 104 and the actual printing target 105 to measure thicknesses of the test substrate 104 and the thickness of the actual printing target 105 in multiple points of their surfaces.

For example, the measurement may be carried out with respect to 25 points of the surface in total, i.e., 5 points evenly present in each of vertical and horizontal directions.

In addition, when the thicknesses of the test substrate 104 and the actual printing target 105 are known in advance, the information thereon would be employed.

In particular, when the same test substrates 104 are employed, the previously-obtained data would be employed, and this step can be omitted.

In the distance-measurement step, a height of the surface of the test substrate 104 or the actual printing target 105 is measured, and the thickness is calculated based on the measured height, and the height of the stage 123.

In the distance-measurement step, the vicinity of the printing site may be measured based on a contact method.

Furthermore, in order to improve productivity, a printing stand-by stage may be provided, and the test substrate 104 or the actual printing target 105 may be subjected to the distance-measurement step at that position.

In the printing process, the distance between the surfaces of the nozzles 102 and the surface of the test substrate 104 or the actual printing target 105 is a critical factor that determines an ink-spotted location.

The distance is calculated by subtracting the measured thickness of the test substrate 104 or the actual printing target 105 from the distance from surfaces of nozzles 102 to the stage 123.

The distance from the surfaces of the nozzles 102 to the surface of the stage 123 is preliminarily stored in the thickness storage unit 119 in the printing control system 124.

The calculated distance between the surfaces of nozzles 102 and the surface of the test substrate 104 or the actual printing target 105 is stored in the thickness storage unit 119.

(ii) Flying Speed/Angle Measurement

Next, flying speed/angle measurement step will be described.

For example, the flying speed and the flying angle can be measured based on the following technique.

Flying positions of the inks at certain time intervals are stored as two or more pictures, and thus, the flying angle can be calculated based on distances from the inks to the moving printing target in the normal and horizontal directions.

Flying positions of the inks at certain time intervals are stored as two or more pictures, and thus, the flying speed can be calculated based on the time and the movement distance.

The measured flying angle and flying speed are stored in an angle/speed storage unit 121.

(iii) Test Printing Step 132

The test printing step 132 is described above.

In this section, calculation of the speed-related displacement 116 based on the angle-related displacement 115 of the ink, and the flying speed of the ink will be described.

In addition, the calculation described below is carried out by an offset-calculation unit 122.

<Angle-Related Displacement 115>

The angle-related displacement 115 ($x_a$) caused due to the presence of flying angle in the actual printing step 133 is calculated based on the following Formula 1-1.

$$x_a = x_0 + \Delta x_a = (G + \Delta G)\tan\theta \quad \text{(Formula 1-1)}$$

In Formula 1-1, $x_0$ represents an initial displacement of the ink-spotted location in the test printing step 132; $\Delta x_a$ represents angle-related displacement 115 due to the presence of the flying angle in the test printing step 132 and the actual printing step 133; G represents a distance between the position of the head and the position of the test substrate 104 in the test printing step 132; and ΔG represents a distance between the test substrate 104 and the actual printing target 105.

θ is a flying angle when the discharged ink is curved at the angle, and is an angle between a normal passing from the test substrate 104 to the surface of the nozzle 102 and the ink-flying direction.

For example, when the flying angle θ=50 mrad, the distance G=1 mm, and the thickness variance ΔG=0.1 mm, $x_a$ is calculated as 55 μm based on Formula 1-1.

<Speed-Related Displacement 116>

The ink-spotted location $x_v$ that is displaced due to the flying speed in the actual printing step 133 is calculated based on Formula 1-2.

$$x_v = x_0 + \Delta x_v = \frac{v_s}{v_f}(G + \Delta G) \quad \text{(Formula 1-2)}$$

In Formula 1-2, $\Delta x_v$ represents the speed-related displacement 116 caused by the flying speed in the test printing step 132 and the actual printing step 133; $v_f$ represents the flying speed of the ink; and $v_s$ represents moving speed of the printing target (the test substrate 104 or the actual printing target 105).

G and ΔG are the same as those mentioned in above Formula 1-1.

When $v_f$=5 m/s, $v_s$=100 mm/s, the distance G=1 mm, the thickness variance ΔG=0.1 mm, $x_v$ is calculated as 20 μm based on Formula 1-2.

Figure 2:
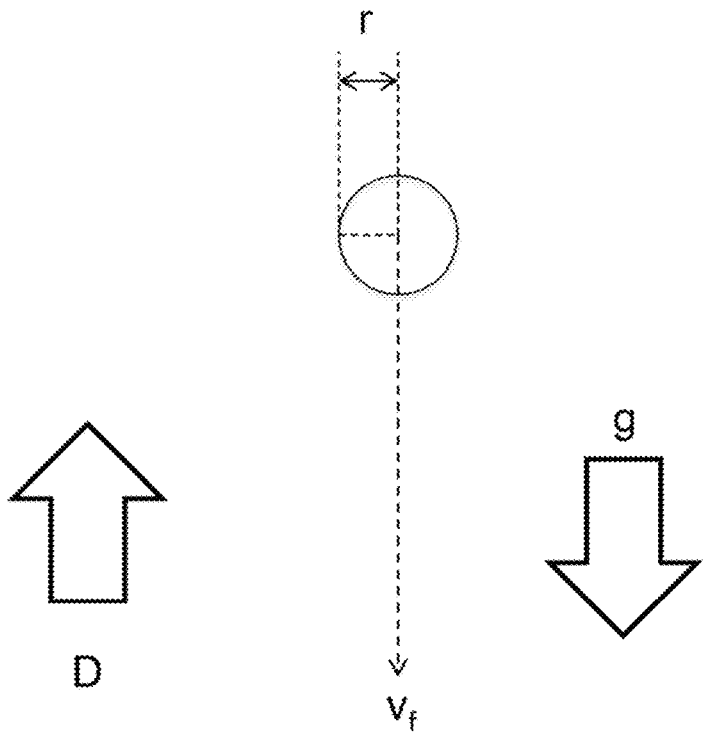
FIG. 2 is a diagram that describes reductions in the speed of droplets in the first embodiment.

Forces that the flying ink receives are shown in FIG. 2.

With reference to FIG. 2, cases in which reductions in the flying speed of the ink needs to be taken into consideration will be described.

The flying ink is subjected to gravitational acceleration, and deceleration due to the air resistance.

The force that the ink receives is represented by Formula 1-3.

$$F = ma = mg - D \quad \text{(Formula 1-3)}$$

In Formula 1-3, m represents a mass of the droplet; a represents the acceleration; g represents the gravitational acceleration; and D represents a drag that the ink receives from the air.

The drag D is represented by Formula 1-4.

$$D = \frac{\rho v_f^2 SCd}{2} \quad \text{(Formula 1-4)}$$

In Formula 1-4, ρ represents a density of the air; $v_f$ represents the flying speed of the ink; S represents a cross-section area of the ink (droplet); and Cd represents a drag coefficient.

The Reynolds number Re is represented by Formula 1-5.

$$Re = \frac{\rho v_f 2r}{\mu} \quad \text{(Formula 1-5)}$$

In Formula 1-5, r represents a radius of the ink.

When the ink flies through the air, the Reynolds number falls well below 1000.

The drag coefficient Cd in such a case is represented by Formula 1-6 based on the Reynolds number.

$$Cd = \frac{24}{R_e} \quad \text{(Formula 1-6)}$$

The drag D that the ink receives from the air is calculated based on Formula 1-7 by way of substituting Formulas 1-5 and 1-6 into Formula 1-4.

In other words, the drag D is a function of the flying speed $v_f$ of the ink.

$$D = \frac{\rho v f^2 S}{2} \times \frac{24\mu}{\rho v f d} = 6\pi r \mu v_f = k v_f \quad \text{(Formula 1-7)}$$

Then, by substituting Formula 1-7 into Formula 1-3, the following Formula 1-8 is obtained.

$$ma = mg - kv_f \quad \text{(Formula 1-8)}$$

Then, by rewriting the acceleration a as dv/dt, and the following Formula 1-9 is obtained.

$$\frac{dv_f}{dt} + \frac{k}{m} v_f = g \quad \text{(Formula 1-9)}$$

Then, by solving Formula 1-9 for $v_f$, the following Formula 1-10 is obtained.

$$v_f = \left(v_{f0} - \frac{mg}{k}\right) e^{-\frac{k}{m}t} + \frac{mg}{k} \quad \text{(Formula 1-10)}$$

In Formula 1-10, $v_{f0}$ represents an initial velocity for the flying speed.

Then, by subjecting Formula 1-10 to time integration, the following Formula 1-11 is obtained for a distance z from the surface of the nozzle 102 to the flying ink.

$$Z = \int v_f dt = -\frac{m}{k}\left(v_f - \frac{mg}{k}\right) e^{-\frac{k}{m}t} + \frac{mg}{k} t + \frac{m}{k}\left(v_{f0} - \frac{mg}{k}\right) \quad \text{(Formula 1-11)}$$

Figure 3:
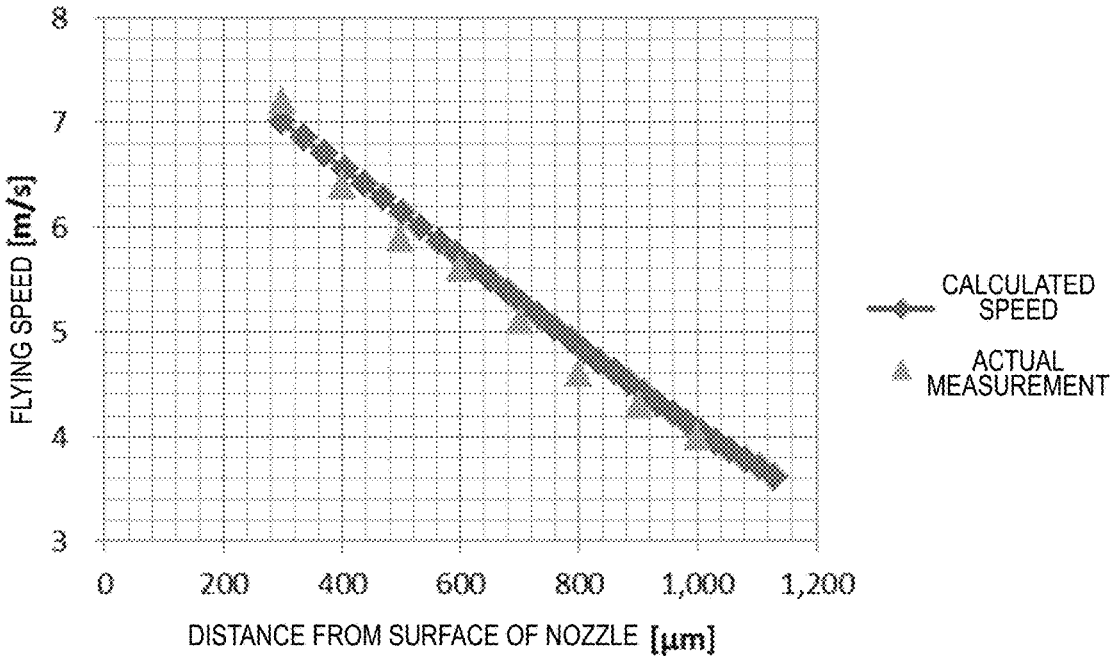
FIG. 3 is a diagram that shows relations between distances from a nozzle surface to a flying ink and a flying speed in the first embodiment.

FIG. 3 shows a graph of experimental results obtained by measuring the relationship between the distance z from the surface of the nozzle 102 to the flying ink surface of the nozzle 102 and the flying speed $v_f$.

The relationships are obtained based on Formulas 1-10 and 1-11.

From the experimental results, it has been revealed that the flying speed $v_f$ of the ink discharged from the surface of the nozzle 102 is decelerated in proportion to the distance z from the surface of the nozzle 102.

Therefore, based on this relationship, the flying speed $v_f$ is represented by the following Formula 1-12.

$$v_f = v_{f0} - AZ \quad \text{(Formula 1-12)}$$

In Formula 12, $v_{f0}$ represents an initial velocity for the flying speed of the ink; A represents a coefficient determined by a density and a volume of the ink; and z represents a distance from the surface of the nozzle 102 to the flying ink.

A mean $v_{fave}$ of the flying speed from the start of flying of the ink to its arrival to the printing target is calculated by Formula 1-13.

$$v_{fave} = \frac{G + \Delta G}{\frac{G}{v_{f0}} + \frac{\Delta G}{v_{f0} - A\Delta G}} \quad \text{(Formula 1-13)}$$

In Formula 1-13, the numerator represents a distance from the surface of the nozzle 102 to the printing target in the actual printing step 133; and the denominator represents a time from the start of flying of the ink to the arrival of the flying ink to the printing target.

Formula 1-13 is transformed into the following Formula 1-14.

$$v_{fave} = \frac{(G + \Delta G) v_{f0} (v_{f0} - A\Delta G)}{(v_{f0} - A\Delta G) G + v_{f0} \Delta G} \quad \text{(Formula 1-14)}$$

Then, $v_{fave}$ in Formula 1-14 is substituted into $v_f$ in Formula 1-2 to obtain the following Formula 1-15.

$$x_v = v_s \frac{(v_{f0} - A\Delta G) G + v_{f0} \Delta G}{v_{f0}(v_{f0} - A\Delta G)} \quad \text{(Formula 1-15)}$$

When $v_{f0}$=5 m/s, $v_s$=100 mm/s, G=1 mm, ΔG=0.1 mm, and A=2600 (a value obtained in the experiment), $x_v$ is calculated as 22 μm.

In cases where high-precision printing is required for certain purposes such as production of display panels, a displacement difference of 2 μm exerts a significant degree of influence. Therefore, it is required that $x_v$ is calculated based on Formula 1-15 that takes into consideration the deceleration.

In the actual printing step 133, as shown in Formula 1-16 below, an ink-spotted location x is a sum of $\Delta x_a$ (the angle-related displacement 115 caused due to the ink-flying angle) and $\Delta x_v$ (the speed-related displacement 116 caused due to the ink-flying speed).

$$x = x_0 + \Delta x_a + \Delta x_v \quad \text{(Formula 1-16)}$$

In Formula, a correction coefficient $C_f$ is defined by Formula 1-17.

$$C_f = \Delta x_a + \Delta x_v \quad \text{(Formula 1-17)}$$

The correction coefficient $C_f$ ($\Delta x_a$, i.e., the angle-related displacement 115, and $\Delta x_v$, i.e., the speed-related displacement 116) is employed in the actual printing step 133.

Second Embodiment (Measurement of Angle)

Figure 4:
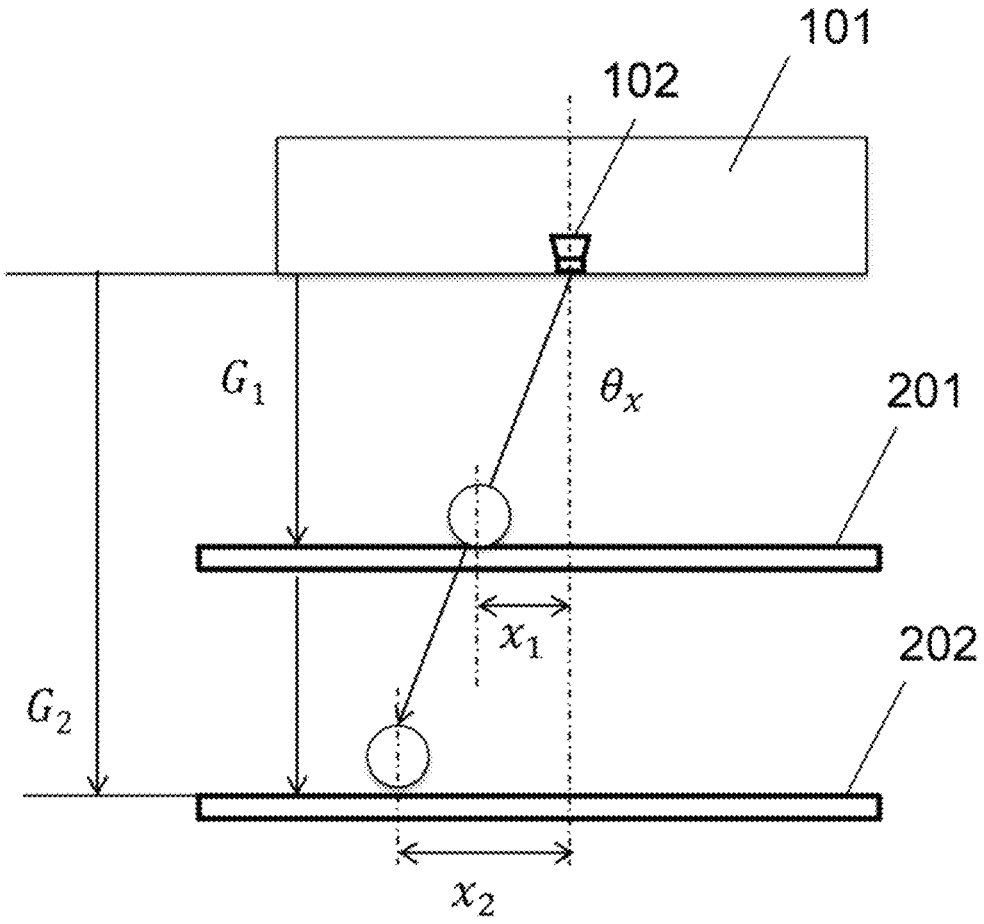
FIG. 4 is a side view of an ink-jet device according to a second embodiment in an ink-discharging state.

FIG. 4 shows a side view of the device during the ink-jet discharging process in the second embodiment.

As mentioned in the first embodiment, there is a method in which images of the flying ink are captured by a camera, and the flying angle of the ink is calculated.

However, according to such a method, it takes longer to carry out the measurement with respect to multiple nozzles 102. Also, illumination in the printing device for the camera is required for capturing the images of the flying ink.

Therefore, the flying angle of the ink is calculated based on the measurement of the ink-spotted location.

In this manner, there are reductions in the costs of facilities and improvements on the production Takt time.

The details will be described below.

While the distance from the surface of the nozzle 102 in the ink-jet head 101 to the printing target is varied with a movable state or printing targets having different thicknesses, ink-spotting is carried out in a state where the stage is immobilized.

By substituting obtained results of the ink-spotting, and the distance from the nozzle 102 to the test substrate 104 into Formula 2-1 below, the flying angle $\theta_x$ of the ink is calculated.

$$\theta_x = \tan^{-1}\frac{x_2 - x_1}{G_2 - G_1} \quad \text{(Formula 2-1)}$$

In Formula 2-1, $G_1$ represents a distance from the nozzle 102 to the printing target A; $G_2$ represents a distance from the nozzle 102 to the printing target B; $x_1$ represents a displacement over the printing target A; and $x_2$ represents a displacement over the printing target B.

However, in some cases, it may be difficult to vary the distance from the surface of the nozzle 102 in the ink-jet head 101 to the printing target by use of a movable stage or printing targets having different thicknesses.

Next, a countermeasure against such cases will be described with reference to FIG. 5.

Figure 5:
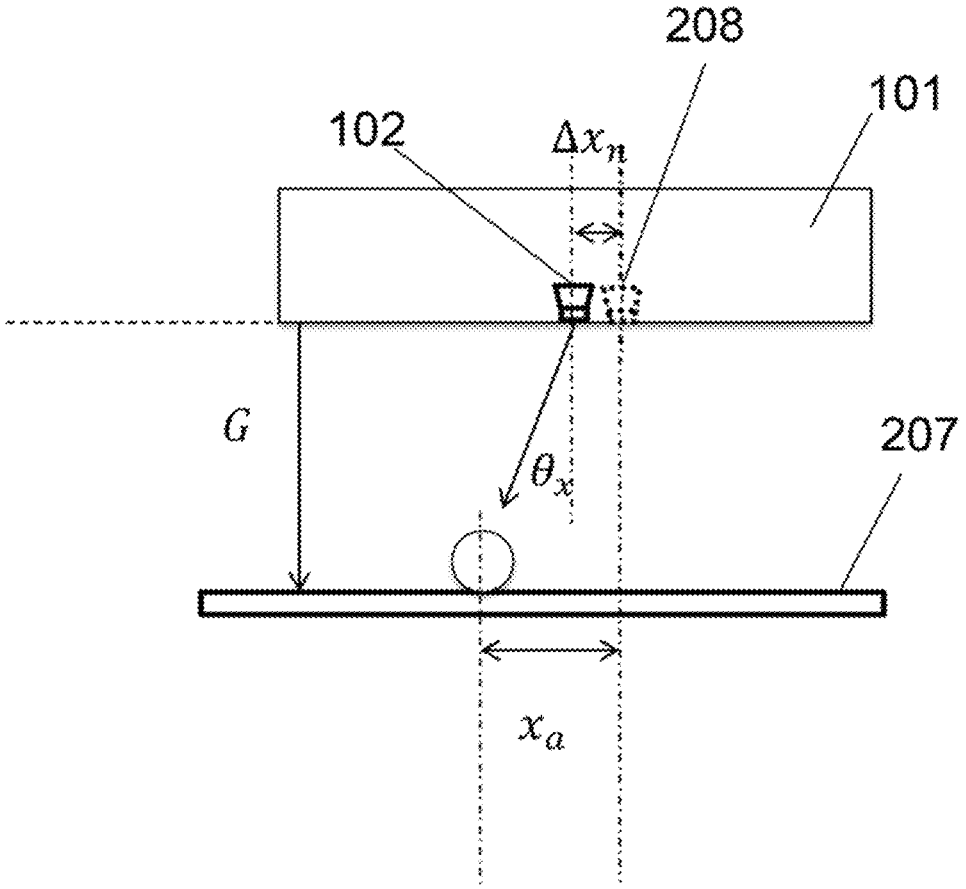
FIG. 5 is a side view of the ink-jet device according to the second embodiment, describing a method for calculating a flying angle.

In FIG. 5, a nozzle displacement $\Delta x_n$ shows how far the nozzles 102 is from the design position 208 of the nozzle.

By substituting the nozzle displacement $\Delta x_n$, an ink-spotted-location displacement $\Delta x_a$ of the ink based on the flying angle of the ink obtained through measurements of ink-spotted location, and the distance G from the nozzle to the printing target 207 to Formula 2-2 below, a flying angle $\theta_x$ of the ink is calculated.

Additionally, with regard to the ink-spotted-location displacement $\Delta x_a$, an averaged location on which the inks discharged from multiple nozzles 102 are spotted is regarded as a standard, and a distance between this standard and the actual ink-spotted position is considered as the displacement $\Delta x_a$.

Based on this displacement, the flying angle of the ink discharged from the nozzle 102 can be calculated.

In the above case, the multiple nozzles 102 are provided in the same ink-jet head 101, and are placed in the depth direction in FIG. 5.

Beside the nozzle 102 in FIG. 5, the multiple nozzles include other nozzles that are placed in the same positional relationship described in FIG. 5.

$$\theta_x = \tan^{-1}\frac{\Delta x_n + \Delta x_a}{G} \quad \text{(Formula 2-2)}$$

It has been confirmed that the flying angle of the ink calculated based on Formula 2-2 almost agreed with the flying angle the ink calculated based on Formula 2-1, in a printing device that had high reproducibility concerning ink-spotting locations.

For example, when $\Delta x_n$=3 μm, $\Delta x_a$=10 μm, and G=0.5 mm, the flying angle $\theta_x$ of the ink is calculated as 14 mrad.

This embodiment is carried out as part of the steps provided in the first embodiment.

Furthermore, this embodiment can be carried out based on results obtained in the test printing step.

This embodiment may be carried out independently of the test printing step.

Third Embodiment (Measurement of Speed)

Figure 6:
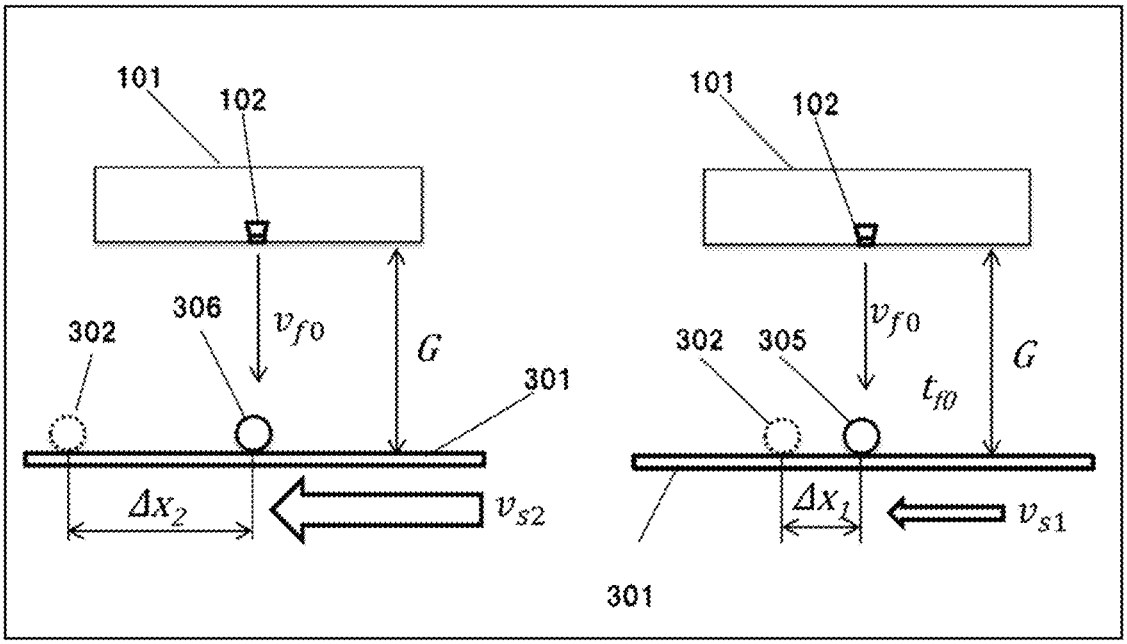
FIG. 6 is a side view of an ink-jet device according to a third embodiment in an ink-discharging state.

FIG. 6 shows a side view of an ink-jet device according to the third embodiment in a state in which the ink is discharged from the nozzle.

As mentioned in the first embodiment, there is a method in which images of the flying ink are captured by a camera, and, based on the captured images, the flying angle of the ink is calculated.

However, according to such a method, it takes longer to carry out the measurement with respect to multiple nozzles 102. Also, illumination in the printing device for the camera is required for capturing the images of the flying ink.

Therefore, the flying angle of the ink is calculated based on the measurement of the ink-spotted location.

In this manner, there are reductions in the costs of facilities and improvements on the production Takt time.

The details will be described below.

When the printing target 301 moves at a low speed $v_{s1}$, the ink is spotted onto an ink-spotted location 305.

The displacement Δx1 corresponds to a distance between the ink-spotted location 305 on which the ink is spotted when the printing target is moved at a low speed, and an ink-spotted location 302 on which the ink is spotted when the printing target is immobilized.

The displacement Δx2 corresponds to a distance between an ink-spotted location 306 on which the ink is spotted when the printing target is moved at a high speed, and an ink-spotted location 302 on which the ink is spotted when the printing target is immobilized.

When the flying speed of the ink is expressed as $v_{f0}$ and the distance from the surface of the nozzle 102 to the printing target is expressed as G, the flying time $t_{f0}$ of the ink can be calculated based on Formula 3-1 below.

$$t_{f0} = \frac{G}{v_{f0}} \quad \text{(Formula 3-1)}$$

In the right-hand diagram in FIG. 6, when a displacement in a case where the printing target is moved at a low speed is expressed as Δx1, and a moving velocity in a case where the printing target is moved at a low speed is expressed as $v_{s1}$, $\Delta x_1$ can be calculated based on Formula 3-2 below.

$$\Delta x_1 = v_{s1} \times t_{f0} \quad \text{(Formula 3-2)}$$

In the right-hand diagram in FIG. 6, when a displacement in a case where the printing target is moved at a high speed is expressed as $\Delta x_2$, and a moving velocity in a case where the printing target is moved at a high speed is expressed as $v_{s2}$, $\Delta x_2$ can be calculated based on Formula 3-3.

$$\Delta x_2 = v_{s2} \times t_{f0} \quad \text{(Formula 3-3)}$$

A difference between Formula 3-3 and Formula 3-4 is calculated based on Formula 3-4 below.

$$\Delta x_2 - \Delta x_1 = (v_{s2} - v_{s1}) \times tf_0 \quad \text{(Formula 3-4)}$$

By substituting Formula 3-1 into Formula 3-4, Formula 3-5 below is obtained.

$$\Delta x_2 - \Delta x_1 = (v_{s2} - v_{s1}) \times \frac{G}{v_{f0}} \quad \text{(Formula 3-5)}$$

Then, by transforming Formula 3-5 into a formula for calculation of the flying time $v_{f0}$ of the droplet, Formula 3-6 below is obtained.

$$v_{f0} = \frac{G(vs_2 vs_1)}{\Delta x_2 - \Delta x_1} \quad \text{(Formula 3-6)}$$

Accordingly, the flying speed $v_{f0}$ of the ink can be obtained from the displacements of the inks spotted on different printing targets.

For example, in a case where G=0.5 mm, the high speed $v_{s2}$ for the printing target is 200 mm/s, the low speed $v_{s1}$ for the printing target is 100 mm/s, the displacement $\Delta x_2$ at the high-speed mode=40 μm, and the displacement $\Delta x_1$ at the low-speed mode=30 μm, the flying speed $v_{f0}$ is calculated as 5 m/s.

This embodiment is carried out as part of the steps provided in the first embodiment.

Furthermore, this embodiment can be carried out based on results obtained in the test printing step.

This embodiment may be carried out independently of the test printing step.

Fourth Embodiment (Influence of Airflows)

In the fourth embodiment, countermeasures against the influence of airflows will be described.

Figure 7:
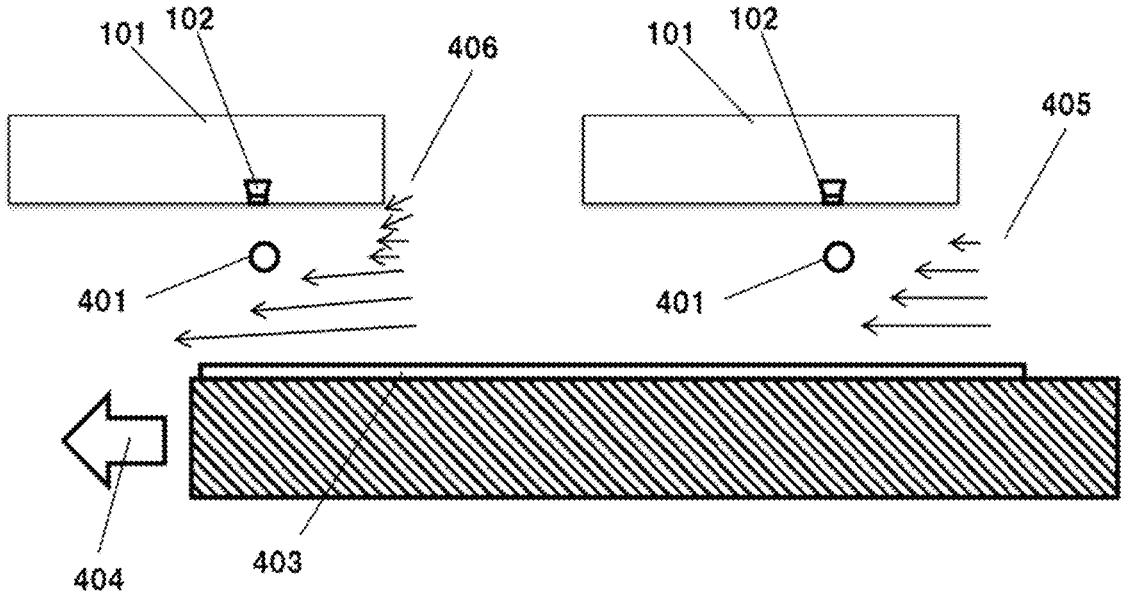
FIG. 7 is a side view of an ink-jet device according to a fourth embodiment in an ink-discharging state.

FIG. 7 shows a side-view of an ink-jet device according to the fourth embodiment in a state where the ink is discharged from a nozzle.

The ink 401 discharged from the nozzle 102 in the ink-jet head 101 will be spotted on a location that is displaced to the moving direction 404 of the printing target, due to the influence of airflows generated by movement of the printing target.

The thickness-related displacement caused due to such influence of airflows is determined by relative positions (locations) of the printing target 403 and the ink-jet head 101.

This is because, when the printing target 403 passes through an area under the ink-jet head 101, disturbed airflows 406 will be generated. Moreover, when the printing target 403 successively passes through an area under the ink-jet head 101, laminar airflows 405 will be generated.

Furthermore, a bias of airflows would be generated in a direction horizontal to the printing target 403.

Figure 8:
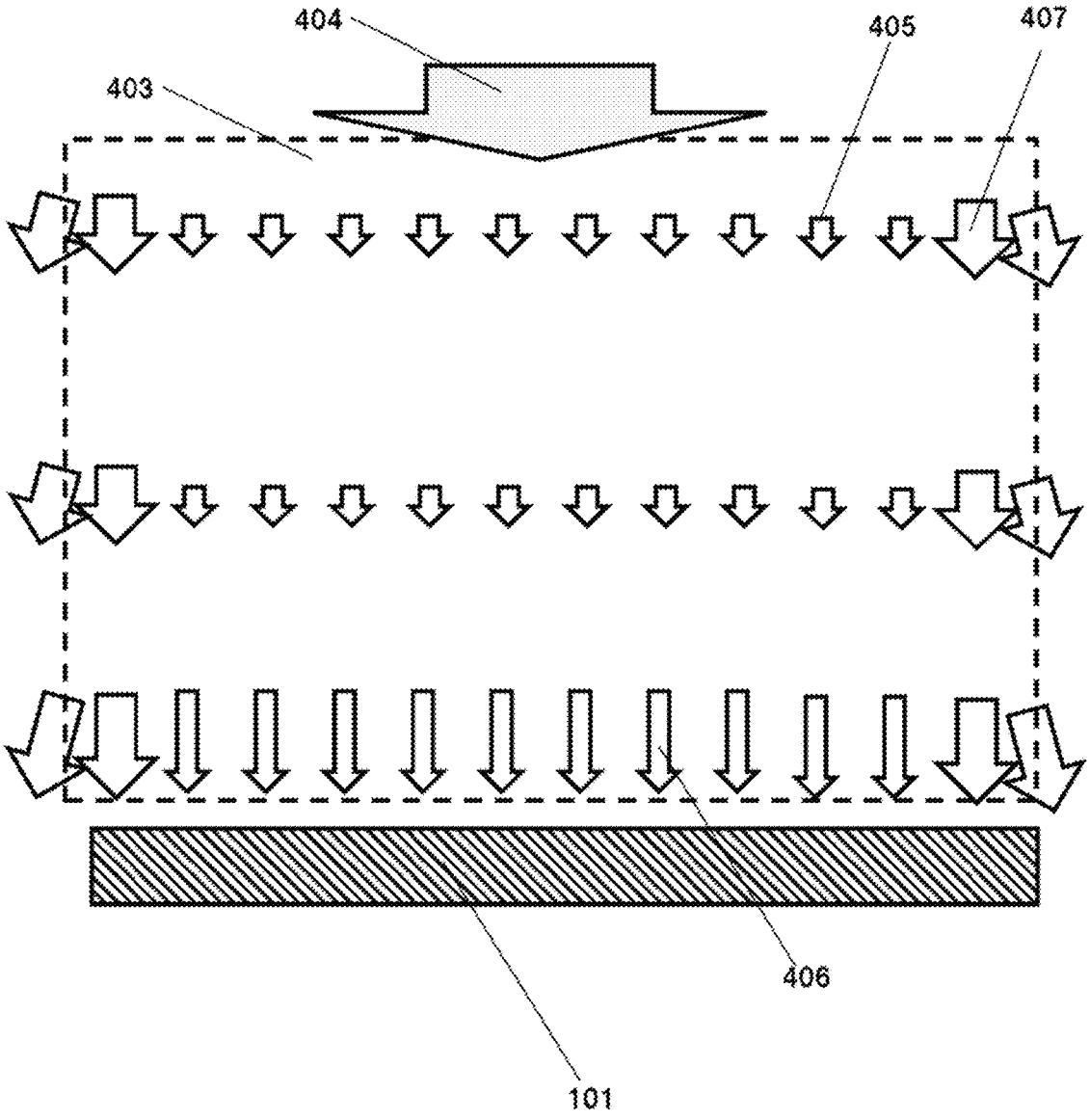
FIG. 8 is a plan view of the ink-jet device according to the fourth embodiment.

FIG. 8 shows a plan view of an ink-jet device according to the fourth embodiment.

As shown in FIG. 8, due to uneven pressures around the edges and the central part of the printing target 403, and the ink-jet head 101, disturbed airflows 407 will be generated around the edges.

In this case, the edges refer to edges of the printing target 403 in a direction vertical to the direction in which the printing target 403 and the ink-jet head 101 are relatively moved in planar view.

In FIG. 8, the above-mentioned edges correspond to the right and left edges.

FIG. 9 shows a correction table for correcting the influence of uneven airflows on ink spotting around the edges and the central area of the printing target.

This correction table shows displacements with respect to respective locations identified by locations of the ink-jet head 101, and respective locations of the printing target 403 in the horizontal direction.

The displacements can be calculated based on a simulation analysis.

An early phase of the actual printing step corresponds to the front side in FIG. 9 while a late phase of the actual printing step corresponds to the depth side in FIG. 9.

Thus, the displacements in the early phase of the actual printing step are larger than the displacements in the late phase of the actual printing step.

Furthermore, with regard to these displacements, edges of multiple nozzles arrayed in the ink-jet head correspond to edges of the ink-jet head, and central parts of the multiple nozzles correspond to a center of the ink-jet head.

Therefore, with regard to the displacements, edges of multiple nozzles arrayed in the ink-jet head are larger than central parts of the multiple nozzles.

Based on the results of measurement of thicknesses of the substrates, and the correction table in FIG. 9, amounts of corrections for respective print sites are determined so as to correct the displacements caused due to the airflows.

It is required that the correction table is updated every time when shapes or moving speeds of the ink-jet head 101 and the printing target 403 are changed.

The correction table may be employed for corrections in the actual printing step in the first embodiment.

Fifth Embodiment (Waveform)

Figure 10:
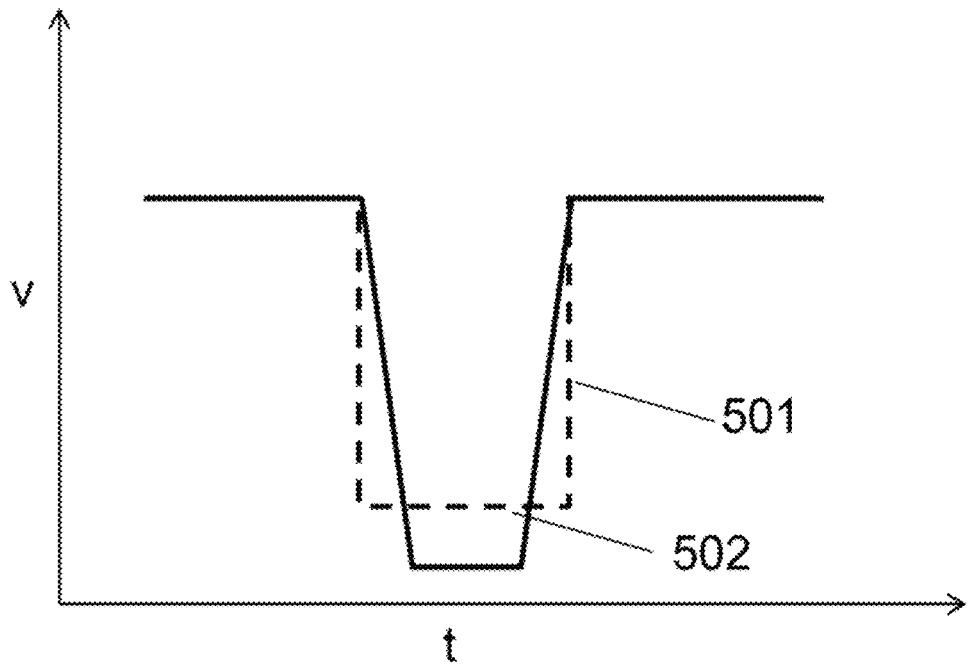
FIG. 10 is a waveform chart for ink-jet discharging in the fifth embodiment.

FIG. 10 is a waveform chart for ink-jet discharging in the fifth embodiment.

The vertical axis represents voltage V applied to the nozzle while the horizontal axis represents time t.

In the first embodiment, the speed of the ink is taken into consideration. However, when the speed of the ink is at an excessively slow speed, only the consideration on the speed of the ink is insufficient.

The term "excessively slow speed" refers to a speed smaller than half of a mean speed of the ink.

In this case, there is a method in which input shapes of waveforms are modified.

However, it is highly possible that volumes of inks discharged from nozzles 102 become uneven, when such a method is employed.

Therefore, without changing an area of the waveform, the rise time and the fall time of the waveform are adjusted within a range from a small flying speed waveform 502 to a large flying speed waveform 501 as shown in FIG. 10 so as to solve the above problem.

In addition, areas depressed portions of the small flying speed waveform 502 and the large flying speed waveform 501 under a certain line where the applied voltage is constant are equal to one another.

Since the areas are equal to one another, amounts of the inks are not changed.

Specifically, at first, the flying speeds of the inks discharged from the nozzles 102 are measured under the same waveform and the same voltage.

For nozzles 102 discharging inks at lower flying speeds relative to other nozzles 102, the large flying speed waveform 501 exhibiting fast rise time and fall time is employed.

On the other hand, for nozzles 102 discharging inks at higher flying speeds, the small flying speed waveform 502 exhibiting slow rise time and fall time is employed.

Additionally, the nozzles 102 discharging inks at higher flying speeds is nozzles discharging inks at speeds higher than double of a mean speed.

In addition, in the actual printing step in the first embodiment, the waveform at the time of ink-jet discharging may be modified.

Accordingly, flying speeds of inks from all of the nozzles 102 can be equalized.

The rise time and the fall time of the waveform are adjusted within a range from a small flying speed waveform 502 to a large flying speed waveform 501, for example, in 255 stages.

The above described embodiments are merely examples for the purpose of illustrating the disclosure. It should not be interpreted that the scope of the disclosure is limited to the embodiments.

Those skilled in the art would be able to carry out the disclosure in different various ways without departing from the spirit and scope of the present disclosure.

Ink-jet heads according to the disclosure are suitably applicable as industrial ink-jet heads.

What is claimed is:

1. An ink-jet printing method, comprising:

(i) measuring a first distance between a printing target and at least one nozzle and measuring a second distance between a test substrate and the at least one nozzle;

(ii) measuring a flying speed and a flying angle of an ink discharged from the at least one nozzle;

(iii) printing an ink spot on the test substrate with the ink from the at least one nozzle to identify a location on which the ink spot is printed on the test substrate, and determining a thickness-related displacement of an ink spot to be printed on the printing target from the location of the ink spot printed on the test substrate, based on a thickness difference between the thickness of the test substrate and the thickness of the printing target, determined by a distance difference between the first distance and the second distance, and the flying speed and the flying angle of the ink measured in Step (ii); and (iv) discharging ink from the at least one nozzle to print the ink spot to be printed on the printing target on the printing target with the ink while correcting the thickness-related displacement of the ink spot to be printed on the printing target from the location on which the ink spot printed on the test substrate is printed on the test substrate.

2. The ink-jet printing method according to claim 1, wherein, when the location of the ink spot printed on the test substrate in Step (iii) is displaced from a target ink-spotting location in Step (iii), a displacement of the location of the ink spot printed on the test substrate from the target ink-spotting location is regarded as an initial displacement, and said initial displacement is corrected in Step (iv).

3. The ink-jet printing method according to claim 1, wherein the thickness-related displacement of the ink spot to be printed on the printing target from the location of the ink spot printed on the test substrate is a sum of an angle-related displacement caused by the flying angle of the ink, and a speed-related displacement caused by the flying speed of the ink.

4. The ink-jet printing method according to claim 1, wherein, in Step (ii), the flying angle of the ink discharged from the at least one nozzle is determined based on the location on the test substrate on which the ink is printed.

5. The ink-jet printing method according to claim 4, wherein the at least one nozzle comprises multiple nozzles, a mean location of ink spots printed from ink discharged from the multiple nozzles on the test substrate is employed as a standard, and the flying angle of the ink discharged from one of the multiple nozzles is determined from the displacement of the location of a printed ink spot discharged from the one of the nozzles from the location of the standard.

6. The ink-jet printing method according to claim 1, wherein, in Step (ii), the flying speed of the ink discharged from the at least one nozzle is determined based on the location on which the ink spot is printed on the printing target.

7. The ink-jet printing method according to claim 6, wherein the flying speed of the ink discharged from the at least one nozzle is determined based on locations on which the ink is printed on the printing target when relative speeds of the printing target and the at least one nozzle are varied.

8. The ink-jet printing method according to claim 1, wherein, in Step (iv), ink-printing locations on the printing target on which ink spots discharged from the at least one nozzle are printed are corrected based on displacements for the ink-printed locations on the printing target.

9. The ink-jet printing method according to claim 8, wherein displacements of ink spots printed on the printing target, by discharging ink from the at least one nozzle, from the location of corresponding ink spots printed on the test substrate by discharging ink from the at least one nozzle in an early phase of Step (iv), earlier than a late phase of Step (iv), are larger than displacements of ink spots printed on the printing target, by discharging ink from the at least one nozzle, from the location of corresponding ink spots printed on the test substrate by discharging ink from the at least one nozzle in the late phase of Step (iv).

10. The ink-jet printing method according to claim 8, wherein the least one nozzle comprises multiple nozzles including central nozzles corresponding to a center of an ink-jet head comprising the multiple nozzles, and edge nozzles corresponding to edges of the ink-jet head, wherein displacements of ink spots printed on the printing target, by discharging ink from the edge nozzles, from the location of corresponding ink spots printed on the test substrate by discharging ink from the edge nozzles are larger than displacements of ink spots printed on the printing target, by discharging ink from the central nozzles, from the location of corresponding ink spots printed on the test substrate by discharging ink from the central nozzles.

11. The ink-jet printing method according to claim 1, wherein, in Step (iv), rise time and fall time of a discharge waveform are further adjusted without changing an area of the discharge waveform in Step (iv).

12. The ink-jet printing method according to claim 1, wherein, in Step (i), multiple, evenly spaced points on a surface of the test substrate and on a surface of the printing target are measured in each of vertical and horizontal directions.

13. The ink-jet printing method according to claim 1, wherein, in Step (ii), the printing target is moving, flying positions of the ink at certain time intervals are stored as two or more pictures, and the flying angle of the ink is determined based on distances from the flying positions of the ink to the moving printing target in normal and horizontal directions.

14. The ink-jet printing method according to claim 1, wherein, in Step (ii), flying positions of the ink at certain time intervals are stored as two or more pictures, and the flying speed of the ink is determined based on a movement distance of the ink over time.

* * * * *